United States Patent [19]

Shah et al.

[11] Patent Number: 4,469,486

[45] Date of Patent: Sep. 4, 1984

[54] STABLE BLEND OF COAL AND DIESEL OIL

[75] Inventors: Dinesh O. Shah; K. C. Adiga, both of Gainesville, Fla.; A. N. SunderRam, Richton Park, Ill.

[73] Assignee: University of Florida, Gainesville, Fla.

[21] Appl. No.: 359,277

[22] Filed: Mar. 18, 1982

[51] Int. Cl.[3] ..... C10L 1/32

[52] U.S. Cl. ..... 44/51

[58] Field of Search ..... 44/51

[56] References Cited

U.S. PATENT DOCUMENTS 3,732,084 5/1973 Nixon et al. ..... 44/51

4,177,039 12/1979 Sakuma ..... 44/51

OTHER PUBLICATIONS

*McCutcheon's Detergents & Emulsifiers,* 1973 North American Ed., McCutcheon's Division, Allured Publishing Co., Ridgewood, New Jersey, p. 129.

*Primary Examiner*—Charles F. Warren

*Assistant Examiner*—Margaret B. Medley

*Attorney, Agent, or Firm*—Arthur G. Yeager

[57] ABSTRACT

A stable dispersion of powdered coal in petroleum oil comprising:

5–50% by weight of pulverized coal;

45–90% by weight of diesel oil or Fuel Oil No. 2; and

5–20% by weight of ethanol.

This dispersion is particularly useful as a liquid fuel.

10 Claims, 1 Drawing Figure

STABLE BLEND OF COAL AND DIESEL OIL

BACKGROUND OF THE INVENTION

Diesel Oil and Fuel Oil No. 2 are distillate oils produced in petroleum refineries principally for use as internal combustion engine fuels. These oils are low in specific gravity and low in viscosity. Attempts to make stable dispersions of pulverized coal in such oils has been accomplished only by adding large amounts of water and several glycols such as ethyleneglycol, polypropyleneglycol, polyethyleneglycol, etc. Such large amounts of water and glycols materially reduce the heating value of the composition, and make its commercial value substantially less.

It is an object of this invention to provide a stable dispersion of coal in diesel oil without the necessity of employing large amounts of water and glycols. It is another object of this invention to provide a blend of coal and diesel oil as an internal combustion engine fuel. It is desirable that such a fuel should have low viscosity and stability so that it can be pumped and stored at ambient temperature. Still other objects will appear from the more detailed description of this invention which follows.

BRIEF SUMMARY OF THE INVENTION

This invention provides a stable dispersion of powdered coal in petroleum oil comprising 5–50% by weight of pulverized coal, 45–90% by weight of diesel oil or Fuel Oil No. 2; and 5–20% by weight of ethanol. A specific embodiment of this composition comprises 10–20% by weight of coal, 65–80% by weight of diesel oil, 10–20% by weight of ethanol, and 0.1–0.5% by weight of a surfactant.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawing in which:

DETAILED DESCRIPTION OF THE INVENTION

Figure 1:
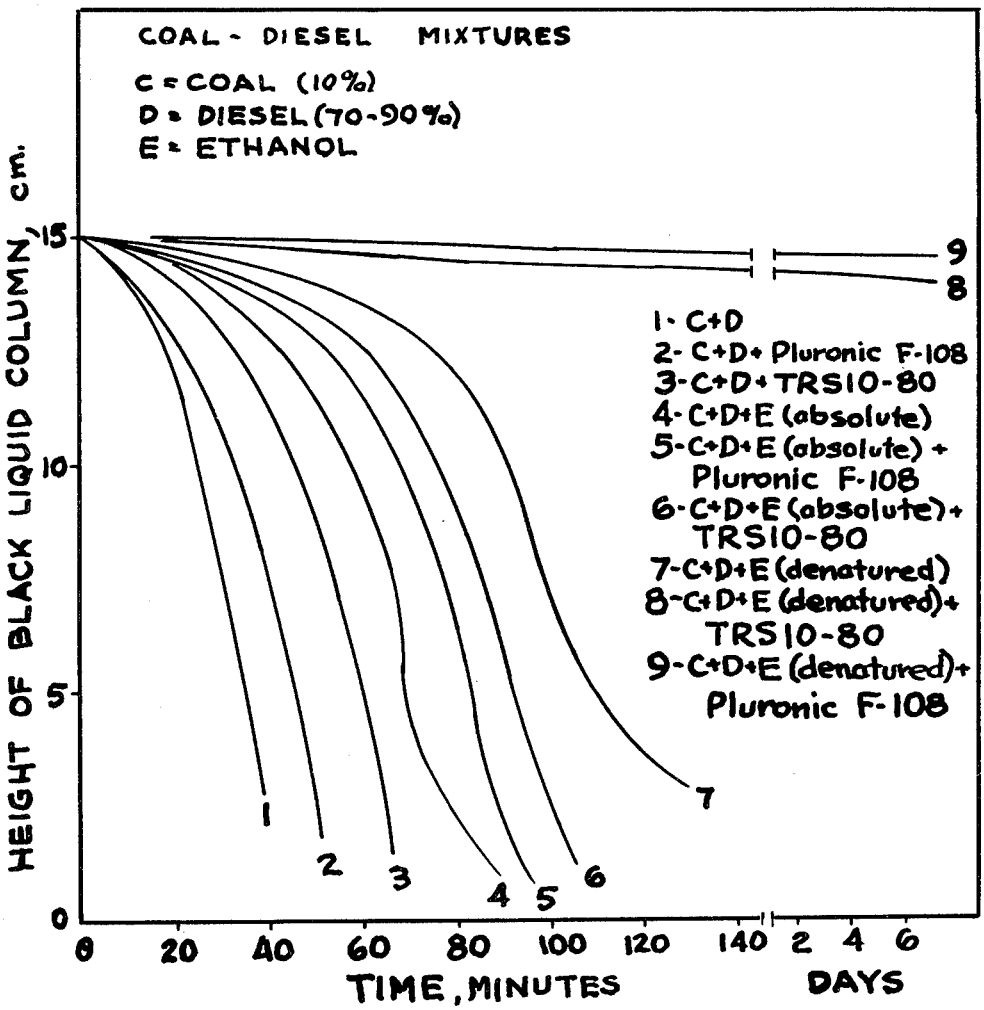
FIG. 1 is a graphic illustration of the comparative stabilities of several compositions of coal and diesel oil.

The composition of this invention includes three required components and one optional component.

The first required component is diesel oil or a similar fraction called Fuel Oil No. 2. These are distillate oils produced in refining crude petroleum oil. The oils intended to be included have a flash point of about 110°–170° F., an A.P.I. of about 30–40, and a Saybolt Universal Viscosity of about 35–38 at 100° F. These oils are intended to be included in the term "diesel oil" as used herein.

The second component is pulverized coal. The particle size of the coal should be about 25–40 microns which is about 350–325 mesh in U.S. Sieve Series. The type of coal, anthracite or bituminous, is not important to this invention since any type will work.

The third component is ethanol. Generally, ethanol is available commercially as "absolute" which is substantially 99–100% ethanol made from any source, e.g. natural gas, catalytic synthesis, biomass conversion, etc. or "denatured" which is absolute ethanol treated with a toxic substance such as methanol, pyridine, or formaldehyde to make it unfit for human consumption. Generally the "denatured" ethanol will also contain 1–10% water.

The optional component is a surfactant which is compatible with the blend of diesel oil, coal, and ethanol. The usual types of surfactants, e.g. sulfonates, compounds with polyalkylene oxide chains, etc. are useful for this purpose. Particularly useful surfactants are TRS 10–80 (Witco Chemicals) and Pluronic F108 (BASF-Wyandotte).

In FIG. 1 several compositions of this invention are compared to a similar composition solely of coal and diesel oil, by graphically showing how stable the dispersions are with respect to time. The dispersion of coal in diesel oil separates with the coal particles settling to about one-half of the total original volume in approximately 30 minutes. The addition of ethanol to such a dispersion in accordance with this invention increases that settling time to about 70 minutes when the ethanol is "absolute" and to about 100 minutes when the ethanol is "denatured". When either of the surfactants, TRS 10–80 or Pluronic F-108 is present in the dispersion employing denatured ethanol, the dispersion remains stable over long periods of time i.e. no settling after as much as 6 days of standing. Thus remarkable improvement is achieved with these specific compositions.

The viscosity of the coal-diesel oil-ethanol-surfactant mixture is not significantly higher than the viscosity of the diesel oil itself. The mixtures exhibit viscosities of about 10–15 cp at ambient temperatures.

The compositions of this invention in their broadset aspects contain 5–50% by weight of pulverized coal, 45–90% by weight of diesel oil or Fuel Oil No. 2, and 5–20% by weight of ethanol. If a surfactant is employed, its concentration is 0.1–0.5% by weight of the total composition. The preferred compositions contain 10–20% by weight of pulverized coal, 65–80% by weight of diesel oil, 10–20% by weight of denatured ethanol, and 0.25–0.5% by weight of TRS 10–80 or Pluronic F-108.

This invention provides an opportunity to obtain a stable coal-diesel oil mixture with a wide range of coal concentrations. The lower concentrations of coal have been difficult to produce in the past due to the low specific gravity and low viscosity of the diesel oil. Stable mixtures with low coal concentrations are especially useful as internal combustion engine fuel. Because of the presence of ethanol, which itself is a good fuel, the stocks of diesel oil will be extended, providing a commercial advantage during this time when petroleum crude oil is increasing in cost. The presence of a small amount of water in the denatured alcohol will provide better combustion since water-in-oil emulsions are known to enhance burning efficiency. The higher concentrations of coal in diesel oil are particularly useful as fuels for industrial and utility boilers, and as fuel for modified internal combustion engines.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A stable dispersion of powdered coal in petroleum oil comprising 5–50% by weight of pulverized coal; 45–90% by weight of diesel oil or Fuel Oil No. 2; and 10–20% by weight of ethanol.

2. The dispersion of claim 1 wherein said pulverized coal has an average particle size of 25–40 microns.

3. The dispersion of claim 1 wherein said petroleum oil is diesel oil.

4. The dispersion of claim 1 wherein said petroleum oil is Fuel Oil No. 2.

5. The dispersion of claim 1 which additionally comprises 0.1–0.5% by weight of a surfactant.

6. The dispersion of claim 1 having a viscosity of about 10–15 cp at ambient temperatures.

7. The dispersion of claim 1 containing 10–20% by weight of coal, 65–80% by weight of diesel oil, and 10–20% by weight of ethanol.

8. The dispersion of claim 7 containing 0.1–0.5% by weight of a surfactant.

9. The dispersion of claim 8 wherein said surfactant is TRS 10-80 or Pluronic F-108.

10. The dispersion of claim 7 having a viscosity of 10–15 cp at ambient temperatures.

* * * * *